US005145522A

United States Patent [19]

Nakagawa et al.

[11] Patent Number: 5,145,522

[45] Date of Patent: Sep. 8, 1992

[54] KETENE DIMER SIZING AGENT FOR PAPER MAKING

[75] Inventors: Hiroshi Nakagawa, Higashiosaka; Atsushi Ikeda, Osaka; Itsuo Sakai, Osaka; Nobuyuki Tani, Osaka, all of Japan

[73] Assignee: Arakawa Kagaku Kogyo Kabushiki Kaisha, Osaka, Japan

[21] Appl. No.: 655,417

[22] PCT Filed: Apr. 25, 1990

[86] PCT No.: PCT/JP90/00546

§ 371 Date: Feb. 4, 1991

§ 102(e) Date: Feb. 4, 1991

[87] PCT Pub. No.: WO90/13707

PCT Pub. Date: Nov. 15, 1990

[51] Int. Cl.[5] ..... C09D 1/00; D21H 71/16; D21H 17/76

[52] U.S. Cl. ..... 106/287.17; 106/243; 162/181.2; 162/181.5

[58] Field of Search ..... 106/287.17, 243, 287.2, 106/655, 417; 162/181.2, 181.5

[56] References Cited

U.S. PATENT DOCUMENTS 3,615,795 10/1971 Schulwitz et al. ..... 106/243
4,964,954 10/1990 Johansson ..... 162/181.2

FOREIGN PATENT DOCUMENTS 759363 5/1967 Canada ..... 162/181.5
0099547 2/1984 European Pat. Off. ..... 162/181.2

*Primary Examiner*—Theodore Morris
*Assistant Examiner*—David M. Brunsman
*Attorney, Agent, or Firm*—Armstrong & Kubovcik

[57] ABSTRACT

The present invention relates to a ketene dimer sizing agent for paper making comprising a dispersed phase containing a ketene dimer and an aqueous continuous phase containing a dispersing agent, characterized by containing polymeric aluminum hydroxide and/or polymeric aluminum chloride. The ketene dimer sizing agent for paper making of the present invention can be preferably used in, for instance, a neutral paper making and the like since it is excellent in sizing effect and storage stability.

6 Claims, No Drawings

KETENE DIMER SIZING AGENT FOR PAPER MAKING

TECHNICAL FIELD

The present invention relates to a ketene dimer sizing agent for paper making, and more particularly to a ketene dimer sizing agent for paper making, which is excellent in sizing effect and storage stability.

BACKGROUND ART

Products made of cellulose fiber such as paper, paper board and woody fiberboard hitherto have been generally produced by adding a sizing agent to an aqueous dispersion of cellulose fiber. As the sizing agent, rosin sizing agents which are chemicals for paper making which can impart water resistance, ink resistance, penetration resistance and the like to obtained products have been usually widely used. The effect of the sizing agent can be for the first time exhibited by fixing the sizing agent on fibers together with aluminium sulfate. Therefore, evil influence due to the use of the aluminium sulfate has been pointed out. That is, since paper is compulsively produced under an acidic condition, there are some problems such as deterioration of properties of produced paper with the passage of time, troublesome treatment for wastewater and corrosion of paper machines. When calcium carbonate which is a cheap filler is used, there is a disadvantage that calcium carbonate decomposes to generate carbon dioxide gas since paper is produced under an acidic condition. Therefore, the filler could not be used.

As a means to solve the above problems, a paper making method under a neutral condition in which aluminium sulfate is not substantially used, has been developed, and ketene dimer sizing agents have been wellknown as one of neutral sizing agents used in the method.

Since the ketene dimer sizing agent is generally stored in a state of aqueous dispersion and used, it is necessitated that the ketene dimer sizing agent is good in stability. However, conventional ketene dimer sizing agents have a mortal defect that the sizing agents are inferior in storage stability due to crystalline property of the ketene dimer component which is a dispersed phase thereof. Also, a method for adding various kinds of noncrystal components has been proposed to improve the stability. However, the method has a defect that the sizing effect is lowered.

The present inventors have eagerly studied to solve the above-mentioned problems with aiming at a material which can act as an agent for improving the stability. As a result, they have found a marvelous fact that a specific polymeric aluminum compound can remarkably improve the storage stability of aqueous dispersion of ketene dimer sizing agent and does not deteriorate the original sizing property of ketene dimer. The present invention has been for the first time accomplished on the basis of the facts.

DISCLOSURE OF THE INVENTION

The present invention relates to a ketene dimer sizing agent for paper making comprising a dispersed phase containing a ketene dimer and an aqueous continuous phase containing a dispersing agent, characterized by containing polymeric aluminum hydroxide and/or polymeric aluminum chloride.

BEST MODE FOR CARRYING OUT THE INVENTION

In the present invention, polymeric aluminum hydroxide and/or polymeric aluminum chloride is contained as an agent for imparting storage stability. As a polymeric aluminum hydroxide used in the present invention, for instance, a compound represented by the general formula (I):

$$[Al(OH)_3]_l.AlCl_3 \quad (I)$$

wherein l is 5 to 25, and the like can be exemplified.

As a polymeric aluminum chloride used in the present invention, for instance, a compound represented by the general formula (II):

$$[Al_2(OH)_nCl_{6-n}]_m \quad (II)$$

wherein n is 1 to 4, m is 1 to 10, and the like can be exemplified.

A polymeric aluminum chloride used in the present invention is usually prepared by dissolving aluminum hydroxide in hydrochloric acid and filtrating the solution. The property is colorless or light yellowish brown liquid at ordinary temperature. As the polymeric aluminum chloride, for instance, ones standarized by Japan Water Works Association (JWWA) Code K 114, and the like can be used.

In the present invention, both polymeric aluminum hydroxide and polymeric aluminum chloride can be used without any limitation of the degree of condensation. However, from the viewpoint of improving effect of storage stability, polymeric aluminum hydroxide is more preferable. Among them, the polymeric aluminum hydroxide represented by the general formula (I) in which n is an integer of 19 to 21 is preferable. Examples of the polymeric aluminum hydroxide are, for instance, trade name Paho #2S, made by Asada Kagaku Kogyo Kabushiki Kaisha, and the like.

As to the sizing agent of the present invention, the used amount of the above-mentioned polymeric aluminum hydroxide and/or polymeric aluminum chloride is not particularly limited, but the amount is usually 0.1 to 20% by weight or so, preferably 0.1 to 10% by weight, more preferably 0.3 to 5% by weight against the ketene dimer which forms a dispersed layer. When the used amount is less than 0.1% by weight, stability cannot be sufficiently improved, and when the used amount exceeds 10% by weight, there is a tendency that the sizing effect is lowered.

As a ketene dimer which forms the dispersed layer of the sizing agent of the present invention, various kinds of known ketene dimers can be optionally selected and used. Examples of the ketene dimers are, for instance, a ketene dimer represented by the general formula (III):

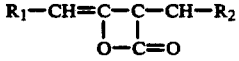

$$R_1-CH=C(-O-C=O)-C(=O)-CH-R_2 \quad (III)$$

wherein each of $R_1$ and $R_2$ is a hydrocarbon residue having 8 to 30 carbon atoms, preferably 10 to 25 carbon atoms, respectively, and the like. In the general formula (III), as the hydrocarbon residue, for instance, an alkyl group such as decyl, undecyl, dodecyl, tridecyl, tetradecyl, pentadecyl, hexadecyl, heptadecyl, octadecyl or eicosyl group; an alkenyl group such as decenyl, tridecenyl, hexadecenyl, octadecenyl or eicosenyl group; and the like can be exemplified. These ketene dimers can be used solely or in admixture thereof. In addition, these ketene dimers can be synthesized from natural fatty acid, beef tallow oil, hardened beef tallow oil and the like.

As a dispersing agent, a cationic dispersing agent can be used in the present invention. The cationic dispersing agent also exhibits a function for fixing an obtained sizing agent on cellulose fibers. As to the above-mentioned cationic dispersing agent, a cationic starch containing at least one kind of primary, secondary and tertiary amino groups and quaternary ammonium salts is usually preferable as a dispersing agent in the present invention. As the cationic dispersing agent used in the present invention, other than the above-mentioned ones, for instance, polyethyleneimine, polyethyleneimineepichlorohydrine condensate, polyamidepolyamineepichlorohydrine resin, polyvinylpyridine, styrenedimethylaminoethyl acrylate copolymer, cationic polyurethane resin, dicyandiamide formaldehyde resin, urea formaldehyde resin, melamine formaldehyde resin, dimethylamine epichlorohydrine resin, and the like can be used. The used amount of these cationic dispersing agents is usually 0.5 to 100% by weight or so, preferably 5 to 30% by weight against the ketene dimer.

Furthermore, in the present invention, other than the above-mentioned cationic dispersing agent, a nonionic dispersing agent such as polyvinyl alcohol or oxidized starch, usual nonionic or anionic surface active agent and the like can be used as occasion demands.

In the present invention, various kinds of additives which are generally used in a ketene dimer sizing agent such as aromatic hydrocarbon resin, alicyclic hydrocarbon resin, hydrogenated petroleum resin and rosin esters can be used.

An aqueous dispersion of the ketene dimer sizing agent for paper making of the present invention can be obtained by adding the above-mentioned various components in a prescribed amount, respectively. The concentration of nonvolatile ingredients in the above-mentioned dispersion is not particularly limited and can be optionally determined, but the concentration is usually 5 to 40% by weight or so. When mixing the components, the order of adding, method for adding and the like are not especially limited. The sizing agent of the present invention can be prepared by suitably selecting the kind of various known methods such as so-called a method for inversion emulsifying, a method for solvent emulsifying and a method for forced emulsifying.

The sizing agent of the present invention is usually used as an internal sizing agent, and is usually mixed with cellulose fibers in an amount of 0.005 to 3% by weight or so, preferably 0.01 to 2% by weight against the cellulose fibers on the basis of dry weight. During paper making, known chemicals such as paper strengthening agent a draining agent can be properly added, and paper making can be carried out within a pH range of neutral or weak alkaline. Therefore, the above-mentioned various problems found in acidic paper making are completely solved. The sizing agent of the present invention can also be used as a surface sizing agent in some cases. The coating amount in this case is usually 0.001 to 5 g/m$^2$ or so in solid content.

The sizing agent of the present invention is more specifically described and explained by means of the following Examples and Comparative Examples. However, it should be understood that the present invention is not limited to the Examples. In the examples, all "parts" and "%" are by weight unless otherwise noted.

EXAMPLE 1

After 240 parts of a ketene dimer produced from hardened beef tallow oil (in the general formula (III), each of $R_1$ and $R_2$ is a mixed alkyl group having 14 to 16 carbon atoms, respectively) (hereinafter referred to as "AKD(a)"), 570 parts of 10% aqueous solution prepared by cooking a cationic starch (nitrogen content at least 0.5%), 20 parts of 15% aqueous solution of polymeric aluminum hydroxide (in the general formula (I), l is 19 to 21) (made by Asada Kagaku Kogyo Kabushiki Kaisha, under the trade name of Paho #2S) and 670 parts of deionized water were charged and they were heated to 70° to 80° C., and pre-dispersion was conducted with a homomixer, they were dispersed by passing through a homogenizer twice at the same temperature under the condition of 300 kg/cm$^2$. Then, the obtained dispersion was immediately cooled to give an aqueous dispersion. The content of nonvolatile components and viscosity (25° C.) of this aqueous dispersion (hereinafter referred to as "sizing agent (1)") are shown in Table 1.

EXAMPLE 2

An aqueous dispersion was prepared in the same manner as in Example 1 except that 240 parts of a ketene dimer produced from stearic acid (in the general formula (III), each of $R_1$ and $R_2$ is an alkyl group having 16 carbon atoms, respectively) (hereinafter referred to as "AKD(b)") was used instead of AKD(a). The content of nonvolatile components and viscosity (25° C.) of this aqueous dispersion (hereinafter referred to as "sizing agent (2)") are shown in Table 1.

EXAMPLE 3

An aqueous dispersion was prepared in the same manner as in Example 1 except that 240 parts of a ketene dimer produced from behenic acid (in the general formula (III), each of $R_1$ and $R_2$ is an alkyl group having 20 carbon atoms, respectively) (hereinafter referred to as "AKD(c)") was used instead of AKD(a). The content of nonvolatile components and viscosity (25° C.) of this aqueous dispersion (hereinafter referred to as "sizing agent (3)") are shown in Table 1.

EXAMPLES 4 TO 6

In Examples 1 to 3, aqueous dispersions (hereinafter referred to as "sizing agents (4) to (6)" in order, respectively) were prepared in order in the same manner as in Examples 1 to 3 except that polymeric aluminum chloride (in the general formula (II), n is 3, m is 1) was used instead of polymeric aluminum hydroxide, respectively. The content of nonvolatile components and viscosity (25° C.) of these sizing agents are shown in Table 1.

EXAMPLES 7 TO 9

In Example 2, various kinds of aqueous dispersions were prepared in the same manner as in Example 2 except that the used amount of polymeric aluminum hydroxide was changed. The content of nonvolatile components and viscosity (25° C.) of the obtained aqueous dispersions (hereinafter referred to as "sizing agents (7) to (9)" in order, respectively) are shown in Table 1.

EXAMPLES 10 TO 12

In Example 5, various kinds of aqueous dispersions were prepared in the same manner as in Example 5 except that the used amount of polymeric aluminum chloride was changed. The content of nonvolatile components and viscosity (25° C.) of the obtained aqueous dispersions (hereinafter referred to as "sizing agents (10) to (12)" in order, respectively) are shown in Table 1.

COMPARATIVE EXAMPLE 1

In Example 2, an aqueous dispersion was prepared in the same manner as in Example 2 except that polymeric aluminum hydroxide was not used. The content of nonvolatile components and viscosity (25° C.) of the obtained aqueous dispersion (hereinafter referred to as "comparative sizing agent (1)") are shown in Table 1.

COMPARATIVE EXAMPLE 2

In Example 2, an aqueous dispersion was prepared in the same manner as in Example 2 except that 3 g of aluminum sulfate was used instead of polymeric aluminum hydroxide. The content of nonvolatile components and viscosity (25° C.) of the obtained aqueous dispersion (hereinafter referred to as "comparative sizing agent (2)") are shown in Table 1.

COMPARATIVE EXAMPLE 3

In Example 2, an aqueous dispersion was prepared in the same manner as in Example 2 except that 3 g of magnesium chloride was used instead of polymeric aluminum hydroxide. The content of nonvolatile components and viscosity (25° C.) of the obtained aqueous dispersion (hereinafter referred to as "comparative sizing agent (3)") are shown in Table 1.

Evaluations of properties of various sizing agents obtained above were conducted according to the following methods. The results are shown in Table 2.

(A) Storage stability (Evaluation method (1))

Change of condition of each dispersion was examined after the dispersion was allowed to stand in air having a temperature of 30° C. for one month.

(Evaluation method (2))

Change of condition of each dispersion was examined after the dispersion was vibrated (80 cycles/minute) in air having a temperature of 30° C. for one week.

(B) Sizing effect

To a 1% aqueous slurry of pulp of Canadian standard freeness of 435 ml (L-BKP) was added each of the above-mentioned various sizing agents in a ratio of 0.3% (in solids content) against the pulp. After that, paper making was carried out by means of a TAPPI standard sheet machine so that the basis weight could be 60±1 g/m$^2$. After the obtained wet web was drained at 3 kg/cm$^2$ for 5 minutes and dried at 100° C. for 1 minute by means of a rotary dryer, obtained paper stock was subjected to conditioning under the condition of 20° C., 65% R.H. for 24 hours.

The Stöckigt sizing degree (JIS P 8122) of the paper stock was measured.

TABLE 1

| Ex. No. | Kind of AKD | Storage stabilizer (part *1) | | Content of nonvolatile components (%) | Viscosity (cP) |
|---|---|---|---|---|---|
| 1 | (a) | PAH | 1.25 | 20 | 15 |
| 2 | (b) | PAH | 1.25 | 20 | 16 |
| 3 | (c) | PAH | 1.25 | 20 | 16 |

TABLE 1-continued

| Ex. No. | Kind of AKD | Storage stabilizer (part *1) | | Content of nonvolatile components (%) | Viscosity (cP) |
|---|---|---|---|---|---|
| 4 | (a) | PAC | 1.25 | 20 | 11 |
| 5 | (b) | PAC | 1.25 | 20 | 10 |
| 6 | (c) | PAC | 1.25 | 20 | 11 |
| 7 | (b) | PAH | 0.1 | 20 | 17 |
| 8 | (b) | PAH | 8.5 | 20 | 16 |
| 9 | (b) | PAH | 18.5 | 20 | 14 |
| 10 | (b) | PAC | 0.1 | 20 | 11 |
| 11 | (b) | PAC | 8.5 | 20 | 10 |
| 12 | (b) | PAC | 18.5 | 20 | 9 |
| Com. Ex. 1 | (b) | Non | | 20 | 12 |
| Com. Ex. 2 | (b) | $Al_2(SO_4)_3$ | 1.25 | 20 | 16 |
| Com. Ex. 3 | (b) | $MgCl_2$ | 1.25 | 20 | 15 |

(Notes)
AKD: Ketene dimer
PAH: Polymeric aluminum hydroxide
PAC: Polymeric aluminum chloride
*1: The amount (parts) against 100 parts of AKD is shown.

TABLE 2

| Ex. No. | Storage stability | | Sizing effect |
|---|---|---|---|
| | Evaluation method (1) | Evaluation method (2) | (Stockigt sizing degree seconds)) |
| 1 | No change | No change | 21.4 |
| 2 | No change | No change | 22.0 |
| 3 | No change | No change | 21.0 |
| 4 | No change | No change | 20.6 |
| 5 | No change | No change | 21.3 |
| 6 | No change | No change | 22.1 |
| 7 | No change | No change | 21.7 |
| 8 | No change | No change | 21.0 |
| 9 | No change | No change | 16.2 |
| 10 | No change | No change | 20.4 |
| 11 | No change | No change | 19.6 |
| 12 | No change | No change | 16.0 |
| Com. Ex. 1 | Creamy | Creamy | 15.4 |
| Com. Ex. 2 | Creamy | Creamy | 15.0 |
| Com. Ex. 3 | Creamy | Creamy | 14.3 |

As is clear from the results shown in Table 2, it is recognized that the ketene dimer sizing agents of the present invention obtained in Examples 1 to 12 are excellent in both storage stability and sizing effect.

INDUSTRIAL APPLICABILITY

The ketene dimer sizing agent for paper making of the present invention can be preferably used in neutral paper making of which improvement has hitherto been required for since the ketene dimer sizing agent of the present invention is remarkably improved in shelf (storage) stability which was a defect of conventional ketene dimers, without the deterioration of sizing effect of original ketene dimer.

We claim:

1. A stabilized ketene dimer sizing agent for paper making consisting essentially of a dispersion of a ketene dimer in an aqueous phase containing a dispersing agent and a polymeric aluminum compound selected from the group consisting of polymeric aluminum hydroxide, polymeric aluminum chloride and mixtures thereof.

2. A sizing agent according to claim 1, in which the polymeric aluminum compound has the formula $[Al(OH)_3]_l.AlCl_3$ wherein l is 5 to 25.

3. A sizing agent according to claim 2, wherein l is 19 to 21.

4. A sizing agent according to claim 1, in which the polymeric aluminum compound has the formula $[Al_2(OH)_nCl_{6-n}]_m$ wherein n is 1 to 4 and m is 1 to 10.

5. A sizing agent according to claim 1 wherein n is 3.

6. A sizing agent according to claim 1, which contains 0.1 to 20% by weight of the polymeric aluminum compound based on the weight of the ketene dimer.

* * * * *